United States Patent [19]

Brovoll

[11] Patent Number: 4,787,309

[45] Date of Patent: Nov. 29, 1988

[54] MOVABLY SUPPORTED SCREW PRESS

[75] Inventor: Oscar Brovoll, Oslo, Norway

[73] Assignee: Kvaerner-Eureka A/S, Tranby, Norway

[21] Appl. No.: 92,580

[22] Filed: Sep. 3, 1987

[30] Foreign Application Priority Data

Sep. 26, 1986 [NO] Norway ..... 863846

[51] Int. Cl.[4] ..... B30B 9/02

[52] U.S. Cl. ..... 100/145; 16/223; 248/667

[58] Field of Search ..... 248/673, 664, 667, DIG. 1, 248/671; 16/223; 100/145–150, 117, 214; 425/208, 376

[56] References Cited

U.S. PATENT DOCUMENTS

| | | | |
|---|---|---|---|
| 267,024 | 11/1882 | See | 100/145 X |
| 713,791 | 11/1902 | Orman | 100/145 X |
| 4,256,035 | 3/1981 | Neufeldt | 100/145 |
| 4,498,382 | 2/1985 | Pera et al. | 100/117 |

*Primary Examiner*—Andrew M. Falik

*Attorney, Agent, or Firm*—Young & Thompson

[57] ABSTRACT

A screw press, and more particularly a pressurized screw press with a driving end, is pivotally mounted at its driving end and rests in a cradle at the other end. A pivotal bearing provided at the driving end of the screw press has a clearance for vertical movement in a fixed axis of rotation. By the aid of this mounting breakage of the screw press casing is avoided when operating conditions comprise varying pressures and temperatures.

6 Claims, 1 Drawing Sheet

MOVABLY SUPPORTED SCREW PRESS

FIELD OF THE INVENTION

The invention relates to a screw press with a driving member, and more particularly a pressurized screw press member. Among other things, screw presses are used for washing cellulose pulp. Such washing is more efficient at increased temperatures. It may also be desired to use a screw press in a pressurized system, e.g. in connection with a refiner.

Under such circumstances the screw press may be subjected to great differences of temperature, e.g. a difference of 160° C. which may result in considerable heat expansion both horizontally and diametrically. The screw press may also be subjected to a considerable reaction pressure from the outlet below the screw press.

SUMMARY OF THE INVENTION

In order to avoid breakage of the screw press casing it is, thus, suggested to arrange for the screw press to be pivotally supported at its driving end and to rest in a cradle at the other end. The screw press casing will, then, be able to slide in a horizontal direction when heated or cooled, and breakages will not occur.

It would also be advantageous to provide the pivotal bearing with a freedom of movement in the direction of the axis of rotation to permit absorption of slight transverse movements as well as compensation of slight mounting inaccuracies.

By placing the point of rotation at the driving end simple mounting is rendered possible, and a slight obliqueness of the foundation or of a possible supporting frame will not be decisive. The active angular momentum is absorbed at the point where it is most in evidence, viz. at the driving end.

BRIEF DESCRIPTION OF THE DRAWING

Further features of the invention will appear from the claims. Below, the invention is disclosed in more detail with reference to the drawing showing an embodiment of the new arrangement according to the invention.

In the drawing

DETAILED DESCRIPTION OF THE INVENTION

Figure 1:
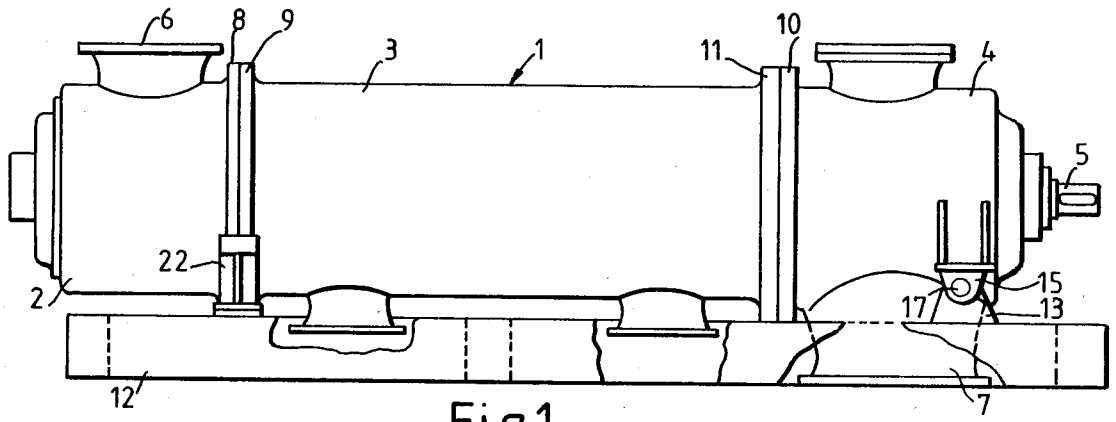
FIG. 1 is a side elevation of a screw press mounted according to the invention.
Figure 3:
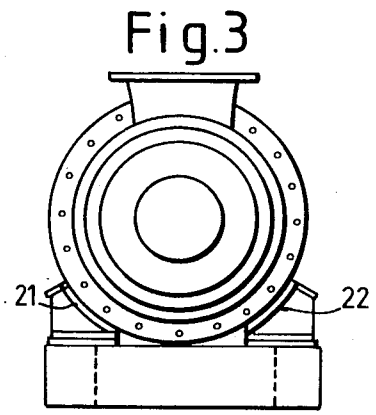
FIG. 3 is an end view as seen from the inlet side of the screw press.
Figure 2:
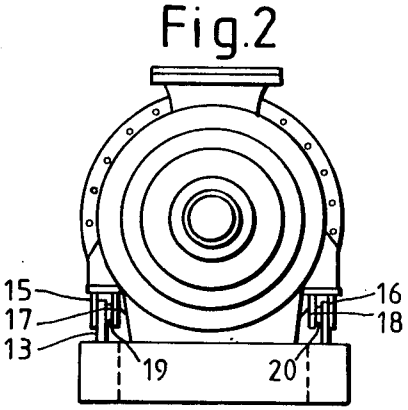
FIG. 2 is an end view of the screw press as seen from the driving side.

Screw press 1, as shown in a side elevation in FIG. 1, is provided with a casing comprising an inlet end casing portion 2, a central casing portion 3, and an outlet end casing portion 4. The shaft of the screw press emerges at the end of casing portion 4 and is designated 5. This is, thus, the driving end of the screw press. The inlet sleeve of the screw press is designated 6 and its outlet sleeve is designated 7. Inlet end casing portion 2 is provided with a flange 8 by the aid of which casing portion 2 is connected with flange 9 of central casing portion 3. Correspondingly, the other end casing portion 4 is provided with a flange 10 which is bolted together with a flange 11 on central casing portion 3.

Screw press 1 rests on a foundation or base or bottom frame 12. Said foundation is shaped like a frame constructed with suitable beam profiles in a manner known per se. Two plate shaped supporting brackets 13,14, one on each side of the centerline of the screw press are welded, projecting upwards, to said bottom frame 12. Two fork shaped bearing brackets depend from outlet end casing portion 4. of the screw press. A bolt 17 and 18, respectively, connects each supporting bracket with its associated bearing bracket to form a pivotal bearing.

As shown, there is a certain clearance for movement 19, 20 in the direction of the axis of rotation formed by bolts 17 and 18, resp.

On bottom frame 12 at the other end of the screw press two supporting shoes 21,22 are provided, projecting upwards from said bottom frame, one shoe at each side of the centerline of the screw press. Each supporting shoe 21, 22 is curved in accordance with the circumference of flanges 8 and 9, and said two flanges, being bolted together, are in contact with said supporting shoes which, thus, form a cradle bearing for the screw press casing. If desired, a lining of stainless steel strip may be provided in the cradle bearing to provide for a smoother surface.

By the aid of the present invention the screw press may be mounted in such a manner as to avoid breakages when the screw press moves due to being subjected to pressure and changes of temperature. In a typical screw press having a length of 3 to 4 meters heat expansion may in fact comprise a horizontal expansion of appr. 10 mm and a diametrical expansion of appr. 3 mm, in case of a temperature difference of 160° C. which temperature difference may in fact, occur if the screw press is used in a pressurized system with a pressure of e.g. 10 bar. The reaction pressures from the outlet end of the press may also be absorbed by the new bearing arrangement.

The screw press may also be connected with a larger mechanical structure that may expand or contract slightly. In such cases the invention will also be advantageous, because the screw press will be effective even though it may, in fact, rise from the cradle.

Having described my invention, I claim:

1. A screw press comprising an elongated casing having a press screw therein, means at one end of the casing for rotating said press screw, a stationary base, means fixedly secured to said stationary base and interconnected with said casing adjacent said one end of the casing for pivotally interconnecting said casing and said fixed base for vertical swinging movement of said casing about a fixed horizontal axis extending perpendicular to the length of said casing, and a cradle on said base a substantial distance from said axis and supporting the other end of said casing for horizontal sliding movement of said casing relative to said cradle.

2. A press as claimed in claim 1, in which said mounting means has clearance for movement of the casing relative to the base in a direction parallel to said axis.

3. A press as claimed in claim 1, in which said pivotal interconnecting means comprises a bracket on each side of the center line of the casing and secured to one of said casing and base, fork-shaped bearing brackets secured to the other of said casing and base and straddling the first-mentioned brackets, and a bolt pivotally interconnecting the brackets on each side of the said center line of the casing.

4. A press as claimed in claim 1, in which said cradle comprises two curved supporting shoes projecting upward from said base, one on each side of the center line of the casing, the casing having correspondingly curved bearing faces that bear downwardly on said supporting shoes.

5. A press as claimed in claim 4, in which said bearing faces on said casing are comprised by portions of two connected flanges on the casing by which two parts of said casing are secured together.

6. A press as claimed in claim 5, in which one said flange is provided on an inlet end casing member and the other said flange is provided on a central casing member of the screw press casing.

* * * * *